US006736865B1

(12) United States Patent
Danner et al.

(10) Patent No.: US 6,736,865 B1
(45) Date of Patent: May 18, 2004

(54) AQUEOUS DISPERSIONS, THEIR PRODUCTION AND USE

(75) Inventors: Bernard Danner, Riedisheim (FR); Francis Palacin, Riedisheim (FR)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 09/720,065

(22) PCT Filed: Jun. 16, 1999

(86) PCT No.: PCT/IB99/01119

§ 371 (c)(1),
(2), (4) Date: Dec. 18, 2000

(87) PCT Pub. No.: WO99/66118

PCT Pub. Date: Dec. 23, 1999

(30) Foreign Application Priority Data

Jun. 18, 1998 (EP) ..... 98810558

(51) Int. Cl.[7] ..... C09B 67/00; C08K 5/01; C08K 5/04; C08J 3/02

(52) U.S. Cl. ..... 8/555; 8/558; 8/617; 524/487; 524/503; 524/521; 524/522; 524/555; 516/77

(58) Field of Search ..... 516/77; 524/487, 524/503, 521, 522, 555; 8/555, 558, 617

(56) References Cited

U.S. PATENT DOCUMENTS

| | | | | | |
|---|---|---|---|---|---|
| 2,328,900 | A | * | 9/1943 | Grimm et al. | 8/555 |
| 3,356,627 | A | * | 12/1967 | Scott | 524/521 |
| 3,912,674 | A | * | 10/1975 | Stahl | 524/272 |
| 4,619,703 | A | * | 10/1986 | Gerber et al. | 106/271 |
| 4,767,669 | A | * | 8/1988 | Conklin et al. | 524/275 |
| 5,250,191 | A | * | 10/1993 | Cory et al. | 210/712 |
| 5,514,187 | A | * | 5/1996 | McFarland et al. | 8/555 |
| 5,601,746 | A | * | 2/1997 | Danner et al. | 106/271 |
| 5,658,577 | A | * | 8/1997 | Fowler et al. | 424/401 |

FOREIGN PATENT DOCUMENTS

| | | | |
|---|---|---|---|
| DE | 24 20 971 A | * | 11/1974 |
| DE | 33 34 575 A | * | 4/1984 |
| EP | 0 314 128 A | * | 5/1985 |
| GB | 853 535 A | * | 11/1960 |
| GB | 993 794 A | * | 6/1965 |
| GB | 2 159 844 A | * | 12/1985 |
| NL | 6 701 483 A | * | 4/1967 |

OTHER PUBLICATIONS

Chem Abstract AN 144915z, IBRAHM, N. A: "Concurrent dying and finishing XIII. Role of acrylamide in simultaneous dying and finishing of PET/C blend fabric", Cellul. Chem. Technol (1995) 29(1), vol. 125, No. 12, pp. 77–86, Sep. 1996, Columbus, OH, Abstract.*

Derwent Database on EAST, week 19680, London: Derwent Publications Ltd., AN 1968–82699P, NL 6701483 A (E I Du Pont De Nemours & Co), abstract.*

Hawley's Condensed Chemical Dictionary, 11th Edition, Edited by Sax and Lewis, Sr. (Van Nostrand Reinhold Co, NY, NY copyright 1987) Oct. 1989, p. 300.*

* cited by examiner

*Primary Examiner*—Daniel S. Metzmaier
(74) *Attorney, Agent, or Firm*—Scott E. Hanf; Anthony A. Bisulca

(57) ABSTRACT

Aqueous dispersions (L) comprising:

(a) a wax which is
  (a1) a carboxyl-containing hydrocarbon wax or a mixture of such waxes or a mixture of (a1) and
  (a2) at least one unmodified hydrocarbon wax, (b) a (co)poly(meth)acrylamide or (co)poly-(meth) acrylamide mixture which is
  (b1) at least one macro(co)poly-(meth)acrylamide, which optionally contains carboxyl-containing comonomers, having an average molecular weight $\bar{M}_W = n \cdot 10^6$, where $n \geqq 10$,
  or a mixture of (b1) and
  (b2) at least one (co)poly(meth)-acrylamide, which optionally contains carboxyl-containing comonomers, having an average molecular weight $\bar{M}_W < 10 \cdot 10^6$, and (d) a dispersant system consisting of amphoteric, anionic and/or nonionic surfactants, are surprisingly useful as highly effective crease mark inhibitors having an extremely surfacy effect and are also suitable for particularly short liquors, for example in winch becks and jet-dyeing machines.

11 Claims, No Drawings

AQUEOUS DISPERSIONS, THEIR PRODUCTION AND USE

BACKGROUND OF THE INVENTION

Undesirable phenomena occurring in the treatment of textile fabrics in rope or tubular form (essentially to pretreat, dye, optically brighten or afertreat them) in an aqueous liquor under such conditions that running creases can form in the textile substrate or friction can take place between the substrate and an adjacent substrate or machine parts are the marking of the running creases and the formation of chafe marks, which subsequently, as corresponding unlevel areas, impair the appearance of the goods and possibly also the physical properties of the treated goods and consequently of the finished goods. To counteract these troublesome phenomena, the process steps in question are carried out with the use of wet-slippage enhancers which reduce the tendency of the textile material to form or stabilize and consequently mark creases, especially running creases, and reduce substrate/substrate and substrate/metal friction and consequently reduce the tendency of the material to form chafe marks. GB-A2282153 discloses wax dispersions which are particularly useful as electrolyte-stable lubricants which act as crease mark inhibitors. The continuous further development of processes and machines with the goal of enhanced performance and environmentally sound processing has led to the development of machines and processes which are designed for higher speeds and higher productivities and/or which operate at shorter liquor ratios. This places greater demands on the employed lubricants. For instance, they have to be resistant to particularly high shearing forces and provide very good performance even in short liquors. The shorter the liquor, the greater the concentration required of the particles treatment chemicals and the greater also, however, the proportion of liquor which (depending on the absorbency of the goods) is absorbed by the goods, so that the wet-slippage of the goods and the achievement of a level solid appearance for the goods without damage to the goods is rendered all the more difficult.

SUMMARY OF THE INVENTION

It has now been found that the hereinbelow defined products (L) are surprisingly useful as highly effective crease mark inhibitors having an extremely surfacy effect and are also suitable for particularly short liquors, for example in winch becks and jet-dyeing machines.

DESCRIPTION OF THE PREFERRED EMBODIMENTS

The invention relates to the products (L), their production and their use.

A first aspect of the invention is accordingly an aqueous dispersion (L) comprising:

(a) a wax which is
  (a1) a carboxyl-group-containing hydrocarbon wax or a mixture of such waxes or a mixture of (a1) and
  (a2) at least one unmodified hydrocarbon wax, (b) a (co)poly(meth)acrylamide or (co)poly-(meth) acrylamide mixture which is
  (b1) at least one macro(co)poly-(meth)acrylamide, which optionally contains carboxyl-containing comonomers, having an average molecular weight $\overline{M}_W = n \cdot 10^6$, where $n \geqq 10$, or a mixture of (b1) and
  (b2) at least one (co)poly(meth)-acrylamide, which optionally contains carboxyl-containing comonomers, having an average molecular weight $\overline{M}_W < 10 \cdot 10^6$, and (d) a dispersant system consisting of amphoteric, anionic and/or non-ionogenic surfactants.

As waxes (a) there may be employed generally known waxes.

As carboxyl-group-containing hydrocarbon waxes (a1) are suitable in general any such synthetic waxes and/or oxidatively modified mineral and/or synthetic hydrocarbon waxes having a wax structure, for example as prepared by copolymerization (e.g. block copolymerization or mixed copolymerization) of olefins, especially ethylene or propylene, with carboxyl-group-containing comonomers, especially (meth)acrylic acid and/or maleic acid, or by graft polymerization, or oxidation products of hydrocarbon waxes or also carboxyl-group-containing waxes synthesized by an optionally oxidative route, such as Fischer-Tropsch waxes and partial saponification products thereof.

The carboxyl-group-containing hydrocarbon waxes (a1) are preferably oxidized and optionally partially saponified hydrocarbon waxes and generally include any desired synthetic and/or mineral waxes which in oxidized form still have a wax structure, especially oxidized microcrystalline waxes or oxidized polyolefin waxes (chiefly polyethylene waxes) or also waxes which are optionally directly synthesized in oxidized form, particularly Fischer-Tropsch waxes, and also their oxidation waxes and where the oxidized waxes mentioned, particularly the oxidized polyolefin waxes and the Fischer-Tropsch waxes, may be optionally partially saponified. Of the waxes mentioned, the oxidized and optionally partially saponified microcrystalline waxes, Fischer-Tropsch waxes and polyethylene waxes are preferred. Such waxes are generally known and can be characterized by customary parameters, such as the needle penetration (for example according to ASTM-D 1321 or -D 5), the solidification point, the drop point, the density, the acid number or/and optionally also the saponification number. Of the waxes (a1) mentioned, preference is given to those whose needle penetration is $\leqq 20$ dmm, particularly those whose needle penetration is within the range from 0.1 to 10 dmm, preferably 0.2 to 5 dmm, and whose acid number is within the range from 5 to 70, preferably 9 to 50. The density of the waxes (a1) is advantageously within the range from 0.90 to 1.1, preferably 0.92 to 1.02, especially 0.94 to 0.99. Of the waxes mentioned, the oxidized polyethylene waxes, chiefly oxidized low pressure polyethylenes, are particularly preferred, especially those having a needle penetration within the range from 0.2 to 5 dmm.

The waxes (a2) are unmodified, i.e. they are hydrocarbon waxes into which no functional groups or hetero atoms have been introduced.

As waxes (a2) there may be employed for example non-oxidized microcrystalline waxes or paraffin waxes.

Suitable waxes (a2) are chiefly paraffin waxes having a drop point $\geqq 40°$ C., advantageously within the range from 40 to 110° C., preferably 50 to 105° C., especially fully refined paraffin scale wax. Advantageously, (a2) contributes up to 130% by weight of (a1), preferably not more than 100% by weight, especially not more than 50% by weight of (a1).

Although (a2) can be present, it is preferred for (a1) not to be cut with (a2), i.e. it is prefered for the entire wax (a) to consist essentially only of (a1). It is especially in the case of the use of the dispersions (L) as wet-slippage enhancers in jet-dyeing machines that it is preferred for the entire wax (a) to consist essentially only of (a1).

(b1) and (b2) can be generally known homopolymers and copolymers, especially homopolymers and/or copolymers of (b') acrylamide and/or methacrylamide and copolymers of (b') and (b") an ethylenically unsaturated carboxylic acid, preferably (meth)acrylic acid, maleic acid and/or itaconic acid.

The fraction of (b') in (b1) is advantageously within the range from 50 to 100 mol %, preferably from 60 to 95 mol %, the remainder to 100 mol %, i.e. 50 to 0 mol %, preferably 40 to 5 mol %, consisting essentially of (b").

The fraction of (b') in (b2) is advantageously within the range from 50 to 100 mol %, preferably from 80 to 100 mol %, the remainder to 100 mol %, i.e. 50 to 0 mol %, preferably 20 to 0 mol %, consisting essentially of (b").

(b1) is required by the invention to be a (meth)acrylamide (co)polymer having a very high molecular weight, herein referred to as a macro(co)poly(meth)acylamide. The average molecular weight $\overline{M}_W$ of (b1) as high as desired and n can be for example within the range from 10 to 80, chiefly n is within the range from 10 to 40, preferably 12 to 30, particularly preferably 15 to 25. In a particular embodiment of the invention, n is ≧16.

(b2) is a polymer which has a lower molecular weight than (b1), specifically an average molecular weight<10 million. Advantageously, the average molecular weight $\overline{M}_W$ of (b2) is within the range from 100,000 to $8\cdot10^6$, preferably within the range from 200,000 to $5\cdot10^6$.

The polymers (b) are known or may be produced by methods which are known per se. The copolymers of (b') and (b") can be prepared by copolymerization processes customary per se, in which dicarboxylic acids, for example maleic acid, may also be used in the form of cyclic anhydrides. Those in which (b") is the comonomer of acrylic acid or methacrylic acid, can also be prepared by hydrolysing a proportion of the amide groups in a corresponding homopolymer or copolymer consisting only of acrylamide and/or methacrylamide units.

The weight ratio of (b2)/(b1) can vary within wide limits. For example, 0 to 30, advantageously 0 to 20 preferably 0 to 10, parts by weight of (b2) are used per part by weight of (b 1). When (b2) is used, it is advantageous to use at least one part by weight of (b2) per part by weight of (b1).

The carboxyl groups can be present in the form of the free acid or in the form of salts, where for salt formation are suitable cations known per se, preferably hydrophilicizing cations, for example alkali metal cations (e.g. sodium, potassium) or ammonium cations {e.g. unsubstituted ammonium, mono-, di- or tri-($C_{1-2}$-alkyl)ammonium, mono-, di- or tri($C_{2-3}$-hydroxy-alkyl)]-ammonium, mono-, di- or tri-[($C_{1-2}$-alkoxy)-($C_{2-3}$-alkyl)]-ammonium or morpholinium}.

The weight ratio of (b)/(a) is advantageously within the range from 1:1 to 1:200, preferably 1:2 to 1:100, more preferably 1:3 to 1:40.

The surfactants (d) are chiefly selected from the following:

(d1) a non-ionogenic surfactant or a mixture of non-ionogenic surfactants, having HLB≧7.

(d2) an anionic surfactant which is a carboxylic acid or sulphonic acid or a sulphuric acid or phosphoric acid partial ester or a salt thereof or a mixture of such anionic surfactants, having HLB≧7, or (d3) an amphoteric surfactant which is an amino- or ammonio-containing carboxylic acid or sulphonic acid or an amine-group- or ammonium-group-containing sulphuric acid or phosphoric acid partial ester or a salt thereof or a mixture, of such amphoteric surfactants, having HLB≧7, or mixtures of two or more of the surfactants (d1) to (d3), especially a mixture of at least one surfactant (d2) with at least one surfactant (d1).

The surfactants (d1), (d2) and (d3) generally have dispersant character.

As surfactants (d1) are generally suitable known compounds, especially those having emulsifier or dispersant character. Emulsifiers and dispersants having a non-ionogenic character are well-known in the art and have been extensively described in the technical literature, for example in M. J. SCHICK "Non-ionic Surfactants" (volume 1 of "Surfactant Science Series", Marcel DEKKER Inc., New York, 1967). Suitable non-ionogenic dispersants (d1) are chiefly oxyalkylation products of fatty alcohols, fatty acids, fatty acid mono- or dialkanolamines (wherein "alkanol" represents "ethanol" or "isopropanol" in particular) or fatty acid partial esters of tri- to hexafunctional aliphatic polyols or else inter-oxyalkylation products of fatty acid esters (e.g. of natural triglycerides), suitable oxyalkylating agents being $C_{2-4}$-alkylene oxides and optionally styrene oxide and preferably at least 50% of the oxyalkylene units introduced being oxyethylene units; advantageously at least 80% of the oxyalkylene units introduced are oxyethylene units; it is particularly preferable for all oxyalkylene units introduced to be oxyethylene units. The starting materials for the addition of the oxyalkylene units (fatty acids, fatty acid mono- or dialkanolamides, fatty alchols, fatty acid esters or fatty acid polyol partial esters) can be any desired customary products as used for preparing such surfactants, chiefly those having 9 to 24, preferably 11 to 22, particularly preferably 11 to 22, carbon atoms in the fat moiety. The fat moieties can be unsaturated or preferably saturated, branched or preferably linear; examples of suitable fatty acids are lauric acid, myristic acid, palmitic acid, stearic acid, oleic acid, arachidic acid and behenic acid and also technical grade fatty acids, for example tallow fatty acid, coconut fatty acid, technical grade oleic acid, tall oil fatty acid and technical grade soya oil acid, and their hydrogenation and/or distillation products; examples of suitable fatty acid mono- or dialkanolamides include the mono- or diethanol- or -isopropanolamides of the acids mentioned; suitable fatty alcohols include the derivatives of the respective fatty acids mentioned and also synthetic alcohols (e.g. tetramethylnonanol). Suitable partial esters of the polyols mentioned include the fatty acid mono- or diesters of glycerol, erythritol, sorbitol or sorbitan, especially the sorbitan mono- or dioleates or -stearates. Of the products mentioned, the oxyalkylated fatty alcohols are preferred, especially the oxyethylation products of saturated, linear fatty alcohols, especially those of the following average formula $$R—O—(CH_2—CH_2—O)_m—H \quad (I),$$

where R is an aliphatic, saturated, linear hydrocarbon radical having 11 to 22 carbon atoms and m is 2 to 16, mixtures of such surfactants.

The HLB value of the surfactants (d1) is advantageously within the range from 7 to 16, preferably within the range from 8 to 15. Of the compounds of the formula (I), particularly those where R contains 12 to 22 carbon atoms, especially 14 to 22 carbon atoms, are preferred.

Suitable anionic surfactants (d2) include acids known per se having a surfactant character, as customarily used per se as dispersants, for example as emulsifiers or as detergents.

Such surface-active anionic compounds are known in the art and have been extensively described in the technical literature, for example in "Surfactant Science Series", volume 7 ("Anionic Surfactants"). More particularly, suitable anionic surfactants contain a lipophilic radical (especially the radical of a fatty acid or an aliphatic hydrocarbon radical of a fatty alcohol) which contains for example 8 to 24 carbon atoms, advantageously 12 to 22 carbon atoms, especially 14 to 22 carbon atoms, and may be aliphatic or araliphatic, in which case the aliphatic radical may be linear or branched, saturated or unsaturated. The lipophilic radicals in the case of carboxylic acids are preferably purely aliphatic and unsaturated, while the lipophilic radicals in the case of sulphonic acids are preferably saturated purely aliphatic or araliphatic radicals, especially as described above for the nonionic surfactants. The carboxylic or sulphonic acid group can be attached directly to the hydrocarbon radical (especially as a fatty acid, for example in the form of soaps, or as an alkanesulphonic acid) or else via a bridge which is interrupted by at least one hetero atom and which is preferably aliphatic. The introduction of carboxyl groups can be effected for example by carboxyalkylation of hydroxyl groups or monoesterification of a hydroxyl group with a dicarboxylic anhydride, for example into such a molecule as mentioned above as starting material for the oxyalkylation to form non-ionogenic surfactants or else of oxyalkylation products thereof, in which case oxiranes can be used for the oxyalkylation, chiefly ethylene oxide, propylene oxide or/and butylene oxide and optionally styrene oxide, and preferably at least 50 mol % of the oxiranes used is ethylene oxide; these are for example adducts of 1 to 12 mol of oxirane to 1 mol of hydroxy compounds particularly as mentioned above as starting material for the alkoxylation. Carboxyalkylation is chiefly carried out using halogenalkanecarboxylic acids, advantageously those wherein the halogenalkyl radical contains 1 to 4 carbon atoms, preferably 1 or 2 carbon atoms, halogen is chiefly chlorine or bromine and the acid group may be present in the salt form, if desired. A carboxyl group can also be introduced for example by monoesterification of an aliphatic dicarboxylic acid, for example by reacting a hydroxy compound with a cyclic anhydride, for example with phthalic anhydride or an aliphatic anhydride having 2 or 3 carbon atoms between the two carboxyl groups, for example sucoinic anhydride, maleic anhydride or glutaric anhydride. In similar fashion it is possible to use esterification also to introduce for example phosphoric acid or sulphuric acid partial ester groups. Useful sulphonic acids are essentially sulphonation products of paraffins (e.g. prepared by sulphochlorination or sulphoxidation), of α-olefins, of alkylbenzenes and of unsaturated fatty acids. The anionic surfactants are advantageously used in the form of salts, the cations for salt formulation being preferably hydrophilicizing cations, especially alkali metal cations (for example sodium, potassium) or ammonium cations [for example those mentioned above] or also alkaline earth metal cations (for example calcium or magnesium). Of the anionic surfactants (d2) mentioned, those without ester groups are preferred, chiefly soaps, especially amine soaps, and also the carboxymethylation products of oxyethylated fatty alcohols and the sulphonic acids, preferably in salt form as mentioned above, particularly as alkali metal salts.

Suitable amphoteric surfactants (d3) likewise include known compounds effective as dispersants, chiefly those which are obtainable by introducing at least one anionic group into a cationic surfactant which contains a reactive hydroxyl or amino group [for example by carboxyalkylation of amino groups, by esterification of hydroxyl groups to introduce sulphato or phosphato groups, by monoacylation of amino or hydroxyl groups with cyclic dicarboxylic anhydrides similarly to the above description relating to (d2), by sulphomethylation of amino groups, for example by reaction with formaldehyde and sodium bisulphite or by reaction of an amino group with the adduct of sodium bisulphite with epichlorohydrin] or also amphoteric compounds of the betaine type. Suitable cationic surfactants for use as starting materials for the reactions mentioned are generally known compounds, for example fatty amines, fatty aminoalkylamines and amidation products of alkylenediamines or polyalkylenepolyamines with a fatty acid radical, or also acylation products of alkanolamines or alkanolaminoalkylamines, and their oxyalkylation products or/and quaternization products. The fatty radicals in (d3) are for example as described above in relation to (d1). The alkylene bridges between two nitrogen atoms in the alkylenediamines, polyalkylene-polyamines and alkanolaminoalkylamines are advantageously those having 2 to 6, preferably 2 to 4, carbon atoms; the alkanol groups in the alkanolamines and alkanolaminoalkylamines are advantageously those have 2 or 3 carbon atoms. Preferred alkylenediamines, polyamines, alkanolamines and alkanolaminoalkylamines are ethylenediamine, propylenediamine, N,N-dimethyl-aminopropylamine, hexamethylenediamine, diethylene-triamine, ethylenepropylenetriaminc, dipropylene-triamine, monethanolamine and 3-(β-hydroxyethyl-amino)-propylamine. Oxyalkylation is preferably effected by adding ethylene oxide, for example 2 to 20 mol of ethylene oxide per mole of amino compound or per mole of fatty radical.

The surfactants (d) are preferably free from readily saponifiable groups, especially ester groups.

Of the surfactants (d1), (d2) and (d3), the surfactants (d1) and especially (d2) are preferred for use as dispersants.

In a particularly preferred embodiment of the invention, (d) consists exclusively of (d2).

The surfactants (d) are advantageously used in such amounts as suffice for well dispersing the waxes (a) in the aqueous phase and forming an aqueous dispersion of (a). The weight ratio of (d)/(a) is for example within the range from 10/100 to 80/100, preferably 20/100 to 60/100.

In addition to the said components (a), (b) and (d), the aqueous dispersions (L) of the invention may comprise further ingredients, especially (c) a crosslinking agent, (e) a hydrotrope and/or protective colloid and/or (f) an agent for counteracting the harmful effect of microorganisms.

Suitable crosslinking agents (c) include those crosslinking agents which are capable of reaction with or respectively crosslinking of amide groups in (b), especially low molecular weight aliphatic compounds, for example an aliphatic aldehyde or an aliphatic diamine in which both amino groups are primary. Examples of aliphatic crosslinking agents suitable as (c) are those having up to 6 carbon atoms, for example formaldehyde and acetaldehyde, and alkylenediamines having 2 to 6 carbon atoms, for example of the formula $$H_2N—(CH_2)_p—NH_2 \quad \text{(II)},$$

where p is 2 to 6, of which are prefered those in which p is 2 or 3.

The crosslinking agents (c) are advantageously used in sufficient amounts for amide groups present in (b) to be at least partially crosslinked. The molar ratio of (c) to the amide groups present in (b) is advantageously within the range from 0 to 10, preferably 0.01 to 5. Among the mentioned crosslinking agents the aldehydes are preferred.

In a particular embodiment of the invention (e) a protective colioid (e1 ) and/or a hydrotrope (e2) is employed in addition to (d).

As used herein, protective colloids (e1) are to be understood as meaning not only highly hydrophilic polymers but also highly hydrophilic surfactants which exert a protective effect on the aqueous two-phase system, particularly in the dispersed particles. These highly hydrophilic surfactants differ from (d) especially in not being dispersants per se, insofar as they are not capable on their own of finely dispersing the waxes, but having a stabilizing effect on the (d)-containing dispersion.

Suitable protective colloids (e1) include any highly hydrophilic products known per se as such, preferably non-ionogenic or amphoteric compounds.

Examples of non-ionogenic protective colloids are polysaccharides chemically modified [e.g. hydroxy-($C_{1-4}$-alkyl)- or/and carboxymethyl- and optionally methyl-modified] for enhanced hydrophilicity, hydrophilic vinyl polymers (e.g. polyvinyl alcohols or polyvinylpyrrolidones) or also ethoxylation products of higher aliphatic alcohols. The HLB of the non-ionogenic protective colloids is advantageously >15, preferably 24 16.5, especially within the range from 16.5 to 19.

Preferred non-ionogenic protective colloids (e1) are oxyethylation products of aliphatic fatty alcohols or synthetic alcohols, for example of those described above as starting materials for the preparation of (d1). Particularly preferred non-ionogenic protective colloids conform to the average formula $$R_1—O—(CH_2—CH_2—O)_q—H \qquad \text{(III)},$$

where $R_1$ signifies an aliphatic hydrocarbon radical having 11 to 18 carbon atoms and q signifies 20 to 100 and can be present as single compounds or also as mixtures of such compounds.

q in the formula (III) preferably signifies 30 to 70, especially 35 to 60.

Suitable amphoteric protective colloids include for example those which can be prepared in a similar manner to that described above for (d3), but which differ from (d3) by higher hydrophilicity, for example by a polyglycol ether chain, a quaternization or protonation, relative to the lipophilic moiety. Suitable in particular are quaternary amphoteric surfactants which contain a fatty radical and a preferably quaternary ammonium group and also an anionic radical and optionally a polyethylene glycol ether chain, chiefly those having a molecular weight within the range from 300 to 3000 for the inner salt form and wherein the fatty radical contains advantageously 8 to 24, preferably 12 to 18, carbon atoms.

If a protective colloid (e1) is used, it is for example within the range from 5 to 50, advantageously 10 to 40, parts by weight, preferably 15 to 35 parts by weight of protective colloid (e1) per 100 parts by weight of (a).

The dispersions (L) may optionally also contain as (e) a hydrotrope (e2), which may also serve as a solubilizer or as an antifreeze.

As hydrotrope or antifreeze (e2) there may be employed products known per se, especially non-ionogenic, chiefly low molecular weight, amides (e.g. acetamide or urea) or aliphatic oligohydroxy compounds [e.g. with 2 to 12, preferably 3 to 10, especially 4 to 8, carbon atoms, e.g. glycerol, hexylene glycol or/and mono- or oligo-($C_{2-4}$-alkylene) glycols] or also their mono-($C_{1-4}$-alkyl)-ethers.

If (e2) is used, its fraction in (L) can vary within wide limits. The weight ratio of (e2) to (L) is advantageously within the range from 0.5 to 15 parts by weight of (e2) per 100 parts by weight of (L), preferably within the range from 1 to 10 parts by weight of (e2) per 100 parts by weight of (L).

The dispersions (L) to be used according to the invention may optionally further comprise at least one ingredient (f) which is advantageously a bacterial growth inhibitor or a microbicide, (f) is selected in particular from fungicides and bactericides, e.g. commercial products, which can be used in the concentrations recommended in each case.

The dispersions (L) of the invention may be prepared in a very simple manner, by suitably mixing the components, especially by mixing an aqueous dispersion (w) of (a) which also includes (d) with an aqueous solution of (b) and optionally adding further ingredients, especially (c), (e) and/or (f).

The aqueous dispersion (w) can be prepared in a very simple manner, for example by diluting with water an appropriate (a) melt which also includes (d) and optionally (e) and to which a base suitable for salt formation with the carboxyl groups (e.g. an alkali metal hydroxide or carbonate and/or an amine which corresponds to the abovementioned cations) may have been added, if desired.

The dispersant system (d) is expediently chosen so that a dispersion of (a) is formed; the components (c), (e) and/or (f) may be added before and/or after the mixing of the (a) dispersion with the (b) solution, whichever is the more convenient. Components (e1) and (e2) are advantageously mixed into the (a) dispersion. Component (c) can be added before or after the mixing of (a) with (b). Component (f) is advantageously added last.

The pH of the dispersions (L) may vary within wide limits, for example within the range from 3 to 12, preferably 4 to 11. The mixing ratios of the respective components and additives, particularly of the anionic components and of any base added, can be chosen accordingly. Crosslinking with (c) is especially favoured by alkaline pH values, for example within the range from 7.5 to 12, preferably 8 to 11.

The aqueous dispersions (L) can in principle be as dilute as desired. Advantageously, they are prepared in a form as concentrated as possible, preferably so as to provide a fine aqueous flowable dispersion. The content of (a)+(b) in (L) is for example within the range from 0.3 to 40% by weight, advantageously 0.6 to 20% by weight, preferably 1 to 5% by weight. The flowability can be determined for example according to the method of ASTM-D 1200, 73/050. The flow time in Ford cup No. 4, at 22° C., is for example 5 to 60 seconds, advantageously 10 to 45 seconds.

The dispersions (L) obtainable as described above are very finely divided; it is possible, for example, to prepare dispersions (L) wherein the size of the dispersed particles is within the range from 0.01 to 10 $\mu$m, preferably 0.05 to 1 $\mu$m. The dispersions (L) can be directly handled and transported in the as-prepared state; it is possible to obtain in particular very stable and fine dispersions (L), including those which are very frost and heat resistant.

The dispersions (L) to be used according to the invention are advantageously essentially free from components other than (a), (b), (c), (d), (e), (f), water and any electrolytes [for example from the preparation of (a), (b) or (d) or from the setting of the pH]. The dispersions (L) of the invention preferably consist essentially of: (a), (b), (d) and water and optionally (c) [crosslinked with (b)], (e) and/or (f) and any optional electrolytes.

The above-described dispersions (L) serve as wet-slippage enhancers, i.e. as auxiliaries in the treatment of textile fabrics with treatment agents (T) (e.g. pretreating, dyeing, optical brightening or aftertreating) under such conditions under which otherwise running creases may form or chafing may take place within or on the substrate, the dispersions (L) to be used according to the invention serving particularly to prevent the stabilization and marking of the creases formed in the course of the treatment and to prevent harmful chafing. Such processes are essentially exhaust processes from a short liquor (weight ratio of liquor/substrate for example within the range from 3:1 to 40:1, usually 4:1 to 20:1) under otherwise customary treatment conditions and times (for example within the range from 20 minutes to 12 hours).

The dispersions (L), in particular, the components (a) and (b) optionally crosslinked with (c), are essentially not substantive and are generally removed again by draining the liquor or/and eliminated in washing and/or rinsing operations of the process.

The treatment agents (T) arc generally textile chemicals which, following the particular treatment of the substrate, are removed again from the substrate, for example by washing or/and rinsing, in respect of the portion which is not fixed on the substrate.

As (T) there may be contemplated in particular the following subgroups:

($T_1$) pretreatment agents (mainly wetting agents, alkalis, detergents, bleaching agents), ($T_2$) main treatment agents (mainly wetting agents, dyes, dyeing auxiliaries, optical brighteners), and ($T_3$) aftertreatment agents (mainly fixing agents for dyeings, detergents, stripping agents, alkalis);

where the respective treatments are carried out in an aqueous medium.

By processes in which running creases may be formed in the textile substrate are meant essentially those processes in which the wet substrate, through the agency and possible interference of various forces, tends to form folds. The folds formed in such processes may become stabilized as creases in the course of the treatment process and become marked at their edges, which can lead to the disadvantages mentioned at the beginning. It is in such processes that the dispersions (L) act as crease mark inhibitors in that they thus favour the slippage of the wet substrat and thus help the wet fabric or folds to glide or glide better and so are able to prevent harmful stabilization of the running folds. Treatment processes likely to cause running folds include chiefly treatments on a winch (especially in a winch beck) or in particular in jet-dyeing machines, wherein the substrate passes with every cycle over the winch or through the jet, the location where fold formation or/and the fold-stabilizing forces acting on the folds are at their most powerful.

By processes in which chafing can take place within or on the textile substrate are meant essentially those in which the wet substrate chafes against machine parts or adjacent substrate parts owing to high transportation speed, routing through jets or/and changes in the transport direction or/and speed.

The areas of chafing produced in such processes can, in the course of the treatment process, lead to the marking thereof and to impairment of the physical properties of the substrate. In such processes, the dispersions (L) act as wet-slippage enhancers in that they favour the slippage of the wet substrat and thus make it possible for the wet fabric to glide or glide better (especially over adjacent fabric or over metal) and so are able to prevent harmful chafing of the substrate. Treatment processes liable to cause chafe marks are chiefly treatments in jet-dyeing machines, wherein the substrate passes in every cycle through the jet, the location in which the relative acceleration or/and the forces acting on the substrate are at their most powerful and wherein the substrate is in every cycle pulled from its position in the liquor to the jet, so that the substrate-relative-to-substrate acceleration or a substrate-relative-to-metal acceleration may cause local friction in the respective areas which can lead to the chafe marks mentioned.

Suitable substrates for the process of the invention and for the wet-slippage enhancer of the invention include in general any substrates as can be used in the processes mentioned, especially those comprising optionally modified cellulose fibres, for example cotton, linen, jute, hemp, ramie and modified cotton (e.g. viscose rayon or cellulose acetates) and also fibre blends with cotton (e.g. cotton/polyester, cotton/polyacrylic, cotton/nylon or cotton/nylon/polyurethane). The textile substrate can be used in any desired form as can be treated in the processes mentioned, for example as tubular material, as open textile webs or else as semi-finished product, essentially in rope form, as is suitable for winch or jet; both knits and wovens can be used (e.g. fine to coarse simple knits or else interlock, fine to coarse wovens, terry towelling, velvet and openwork or/and machine-embroidered in textiles).

The wet-slippage, enhancers (L) of the invention are expediently used in such concentrations that crease marking and chafe marking is effectively prevented in the particular process. They are notable for their effectiveness and yield and can provide a very high effect in very low concentrations; they are advantageously used in such concentrations which correspond to 0.01 to 2 g of [(a)+(b)] per liter of liquor, chiefly 0.02 to 1.5 g of [(a)+(b)] per liter of liquor, preferably 0.03 to 1 g of [(a)+(b)] per liter of liquor, particularly preferably 0.04 to 0.5 g of [(a)+(b)] per liter of liquor.

Since the wet-slippage enhancers (L) of the invention are also notable for substantial independence of temperature fluctuations and are substantially electrolyte-stable, they can also be used in a very wide choice of treatment conditions as occur in the art for the treatment with textile chemicals (T), especially for pretreatment with ($T_1$), dyeing or optical brightening with ($T_2$) or for aftertreating with ($T_3$), for example with ($T_1$) during scouring (in kiering, for example), in desizing or in bleaching, with ($T_2$) in dyeing or optical brightening or else with ($T_3$) in aftertrmating, especially with cationic fixing agents to improve the dyeing fastnesses (especially the wetfastnesses), but in particular in dyeing. Dyeing or optical brightening may be carried out using any desired dyes or optical brighteners ($T_2$) which are suitable for the particular substrate and process and for the desired effect. For the dyeing of cellulosic substrates there may be employed any desired dyes for cellulose, for example reactive dyes, direct dyes, vat dyes, sulphur dyes or else basic dyes, in which case substrates comprising fibre blends, especially of cellulosic fibres and synthetic fibres, can also be dyed using appropriate additional dyes, especially disperse dyes. The processes can pass through any desired temperature ranges as are used for the particular substrate and the treatment composition used and also as dictated by the apparatus and the desired purpose, for example from room temperature (at the start of dyeing, for example) up to HT conditions (for example within the range from 102 to 140° C. in a closed apparatus). Similarly, the electrolyte content of the liquors can be any which is otherwise customarily used for the respective processes, for example corresponding to the alkali metal compound concentrations used in each case for scouring, for bleaching or for desizing, or else the alkali metal salt (for example sodium chloride or sodium sulphate) concentrations or/and alkali metal hydroxide or carbonate concentrations as used for dyeing with the dyes mentioned, whether as blending component in commercially available dye products or/and as exhaustion auxiliaries for dyeing or optical brightening, or else as alkalis which are used for dyeing with sulphur dyes, vat dyes or reactive dyes.

As aftertreatment agents ($T_3$) to enhance the fastness properties of the dyeings there may generally be used conventional polycationic products of high charge density, chiefly aliphatic condensation products of dicyandiamide or epichlorohydrin with an aliphatic mono- or polyamine or of epichlorohydrin and ammonia, which are optionally present in protonated form. Such aftertreatments are advantageously carried out using such dispersions (L) wherein (b) is essentially free of carboxyl groups and (d) consists of (d1), whereas in an (L) used for pretreatment, dyeing and brightening the dispersing system (d) preferably consists of (d1) or/and (d2).

The dispersions (L) are particularly advantageously used as wet-slippage enhancers in dyeing, preferably in jet-dyeing machines, particularly preferably for the dyeing of cellulosic substrates.

Owing to their high stability to temperature fluctuations and high electrolyte concentrations, the wet-slippage enhancers (L) of the invention can be used under the conditions mentioned, and perform optimally, without their effectiveness being impaired. Owing to the substantial shearing force stability of the wet-slippage enhancers (L), especially of those which do not include any non-oxidized waxes (a2) but consist only of (a1),(b), (d) and optionally (c), (e) and/or (f) in aqueous dispersion, these are also particularly useful as wet-slippage enhancers in jet-dyeing machines, including especially in those wherein the fabric and the liquor are exposed to extremely high dynamic stresses, i.e. wherein very high shearing forces are developed in the liquor.

The dispersions (L) provide a very good, extremely surfacy wet-slippage effect even in very short liquors, for example at liquor/goods ratios≦15/1, particularly also <10/1, especially in that they ensure that the slippage enhancer becomes concentrated at the fabric surface and the liquor becomes concentrated in the direct environment of the slippage enhancer and, as a flowing layer of liquor, facilitates the wet-slippage of the fabric to a surprisingly high degree.

The use of the wet-slippage enhancers (L) of the invention, even from very short liquors, provides for example optimally pretreated, optically brightened, dyed or/and aftertreated materials in which the effect of the respective treatment composition (pretreatment agent, dye, optical brightener or, aftertreatment agent) is not impaired and the appearance of the goods is optimal.

The effectiveness of the product (L), especially in the immersion region, can be determined by measuring the coefficient of friction, for example as follows: A first piece of cloth is clamped into a low, shallow trough so as to bear against the inner surface of the base thereof, secured at one end with a clamp and covered with an amount of liquor which corresponds to liquor ratios customary in the art, a 200 g weight having a smooth, flat, rectangular base onto which a second piece of the same cloth has been stretched and secured is placed horizontally on top. The weight covered with the second piece of cloth is then pulled like a sledge in the longitudinal direction of the trough and of the first piece of cloth (the slide, as it were) until the sledge starts to move and until it has reached a constant velocity, and the pulling force is measured which is required to start the sledge to move horizontally on the slide, starting from the end fixed with the clamp, and to move horizontally at constant speed in the pulling direction. This makes it possible to determine not only the static friction but also the kinetic friction and thus not only the coefficient of static friction but also the coefficient of kinetic friction. Let $N_0$ be the normal force (i.e. the weight of the sledge on the slide), $Z_S$ the horizontal pulling force necessary to get the sledge moving on the slide and $Z_K$ the horizontal pulling force required to keep the sledge moving on the slide at a constant speed, then the coefficient of static friction $\mu_S$ can be expressed by the following formula:

$$\mu_S = \frac{Z_S}{N_0}$$

and the coefficient of kinetic friction $\mu_K$ by the following formula:

$$\mu_K = \frac{Z_K}{N_0}$$

The use of (L) provides very low values not only for $\mu_K$ but also for $\mu_s$.

Visually, the effectiveness, which is indicated by the formation of a specular liquor surface on a taut fabric pulled upwardly out of the (L)-containing liquor, can be observed above the liquor by the specular reflection of light at the fabric.

The overall effectiveness of the wet-slippage enhancers can be ascertained visually through inspection of the appropriately treated fabric for chafe marks or crease marks (for example on a dyeing).

EXAMPLES

In the Examples hereinbelow, parts and percentages are by weight; temperatures are reported in degrees Celsius. In the application examples, the dyes are used in commercial form with an active substance content of about 25%; the reported concentrations are based on that form. C.I. stands for Colour Index. Sodium sulphate is used in the form of Glauber's salt, and the reported amounts of sodium sulphate are based on Glauber's salt. The waxes, dispersants and protective colloids referred to in the examples in abbreviated form in terms of a letter and a number only are the following:

Wax (A11)

| Oxidized polyethylene with | |
|---|---|
| drop point | 103–105° C. |
| acid number | 25 |
| density | 0.96 |
| needle penetration (ASTM D-1321) | 5 dmm |

Dispersant (D11)

$$C_{18}H_{37}—(OCH_2CH_2)_{10}—OH$$

Protective colloid (E11)

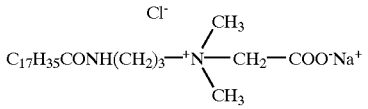

Protective colloid (E12)

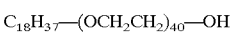

Macrocopolyacrylamide(B11)

Partially hydrolysed polyacrylamide having a molecular weight $\overline{M}_W$ of $20\cdot10^6$ and 27±3 mol % of $CH_2$—CH—COONa monomer units.

Polyacrylamide (B21)

Polyacrylamide (homopolymer) having a molecular weight $\overline{M}_W$ of $2\cdot10^6$.

Example 1

54.0 parts of wax (A11) are heated to 120° C. under nitrogen and then reacted first with 9.5 parts of oleic acid and then with 9.5 parts of 3-methoxy-propylamine. The clear, homogeneous melt obtained is then added to 394.0 parts of water at 94–96° C. with stirring to form a fine, almost transparent dispersion, which is cooled down to 30° C. Then 73.0 parts of a 29% strength solution of (E11) in a mixture of 15% of hexylene glycol, 65% of dipropylene glycol and 20% of water are added to obtain 540.0 parts of a wax dispersion (W1), which are added to 2451.0 parts of an aqueous solution of 3.0 parts of macrocopolyacrylamide (B11) in 2448.0 parts of water at room temperature with stirring.

Then 6.0 parts of a 37% strength aqueous formaldehyde solution are added, followed by 3.0 parts of 1.5% strength aqueous solution of 2-methyl-4-iso-thiazolin-3-one additionally comprising 1.75% of $Mg(NO_3)_2$, 0.85% of $MgCl_2$ and 0.12% of $Cu(NO_3)_2$, as microbicide, and the batch is then discharged to afford 3000.0 parts of an aqueous dispersion (L1) having a flow time (Erichsen, Ford cup No. 4, ASTM-D 1200, 73/050) of 32 seconds (at 22° C.).

Example 2

560.0 parts of a 3% strength aqueous solution of a polyacrylamide (B21) are diluted with 1894.9 parts of water. Then 2.1 parts of macrocopolyacrylamide (B11) are added with stirring. As soon as a homogeneous solution is present, 3.0 parts of a 37% strength aqueous formaldehyde solution are added, followed by 540 parts of wax dispersion (W1) (as in Example 1) to afford 3000.00 parts of an aqueous dispersion (L2) having a flow time (Erichsen, Ford cup No. 4, ASTM-D 1200, 73/050) of 38 seconds (at 22° C.).

Example 3

76.6 parts of dipropylene glycol are heated to 120° C. under nitrogen and then admixed with 112.4 parts of wax (A11) to form a clear transparent solution, which is then admixed with 25.8 parts of dispersant (D11). Following the addition of 3.8 parts of potassium hydroxide, the homogeneous melt is added to 265.6 parts of water at 94–96° C. with stirring. The batch is then cooled down to 30° C., and the nearly transparent dispersion is admixed with 55.8 parts of a 30% strength aqueous solution of the protective colloid (E12) to obtain 540.0 parts of wax dispersion (W2), which are further formulated in the same way as (W1) in Example 1 to obtain 3000.0 parts of an aqueous dispersion (L3) having a flowability (Erichsen, Ford cup No. 4, ASTM-D 1200, 73/050) of 30 seconds (at 22° C.).

Application Example A

[Dyeing of Pure Cotton with Reactive Dyes—At Low Temperature—in the Winch Beck]

1400 parts of a 40° C. aqueous liquor containing 120 parts of sodium sulphate and 3 parts of dispersion (L1) are entered with 100 parts of cotton fabric. A solution of 3.3 parts of C.I. Reactive Red 147 in 100 parts of water is added to the bath, and the machine is run at 40° C. for 30 minutes. Then 5 times 20 parts each time of a 10% strength sodium carbonate solution are added at intervals of 5 minutes. The temperature is then raised to 60° C. and the dyeing is continued at that temperature for a further 30 minutes. The customary finishing (rinsing, washing) provides a very level red dyeing having an excellent appearance.

Application Example B

[Dyeing of Pure Cotton with Reactive Dyes in Jet-dyeing Machine (Rotostream Thies)]

600 parts of an 80° C. aqueous liquor containing 70 parts of sodium sulphate and 2 parts of dispersion (L1) are entered with 100 parts of cotton fabric. A solution of 3.1 parts of C.I. Reactive Blue 52 in 100 parts of water is added to the bath, and the liquor is heated to 95° C. After 30 minutes at this temperature 5 times 4 parts each time of a 3% strength NaOH solution are added at intervals of 5 minutes and the dyeing is continued for a further 40 minutes. The customary finishing (rinsing, washing) provides a very level and solid blue dyeing.

Instead of (L1), the same amounts of dispersion (L2) or (L3) can also be used in Application Examples A and B.

What is claimed:

1. A process for pretreatment of a textile material comprising the step:

providing a vessel;

providing a textile material;

providing an aqueous liquor;

adding textile pretreatment agents ($T_1$);

adding an aqueous dispersion (L) comprising;

(a) a wax which is (a1) a carboxyl-containing hydrocarbon wax or a mixture of such waxes or a mixture of (a1) and (a2) at least one unmodified hydrocarbon wax, (b) a compound selected from the group consisting of: polyacrylamide; copolyacrylamide; copolymethacrylamide; polymethacrylamide; or mixtures thereof, which is (b1) at least one macrocompound where said macro compound is selected from the group consisting of a homopolymer of acrylamid or methacrylamide, a copolymer of acrylamide and methacrylamide, or a copolymer of acrylamide and/or methacrylamide with a carboxyl containing comonomer, having an average molecular weight $\overline{M}_W = n\cdot10^6$, where $n \geqq 10$, or a mixture of (b1) and (b2) at least one compound selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W < 10 \cdot 10^6$, where components (a) and (b) constitute dispersed particles, said dispersed particles range in size from 0.01 to 10 $\mu$m;

and (d) a dispersant system consisting of amphoteric, anionic and/or nonionic surfactants;

optionally providing customary textile auxiliary chemicals;

contacting said bath with said textile material;

optionally providing heating;

optionally providing rinsing;

and optionally providing washing.

2. A process for treating a textile material with a main textile treatment agent ($T_2$) comprising the steps:

providing a vessel;

providing a textile material;

providing an aqueous liquor;

adding textile treatment agent ($T_2$);

adding an aqueous dispersion (L) comprising:

(a) a wax which is (a1) a carboxyl-containing hydrocarbon wax or a mixture of such waxes or a mixture of (a1) and (a2) at least one unmodified hydrocarbon wax, (b) a compound selected from the group consisting of: polyacrylamide; copolyacrylamide; copolymethacrylamide; polymethacrylamide; or mixtures thereof, which is (b1) at least one macrocompound where said macro compound is selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W = n \cdot 10^6$, where $n \geqq 10$, or a mixture of (b1) and (b2) at least one compound selected from the group consisting of a homopolymer of acrylamide or methacrylamide, or a copolymer of acrylamide and methacrylamide, or a copolymer of acrylamide and/or methacrylamide with a carboxy containing comonomer, having an average molecular weight $\overline{M}_W \leqq 10 \cdot 10^6$, where components (a) and (b) constitute dispersed particles, said dispersed particles range in size from 0.01 to 10 $\mu$m;

and (d) a dispersant system consisting of amphoteric, anionic and/or nonionic surfactants;

adding the main textile treatment agent ($T_2$);

optionally adding customary textile auxiliary chemicals;

contacting the said textile material with said aqueous bath;

optionally providing customary heating;

optionally providing rinsing;

and optionally providing washing.

3. The process for aftertreatment of a textile material comprising the steps:

providing a jet-dyeing vessel;

providing a textile material;

providing an aqueous liquor;

adding textile aftertreatment agent ($T_3$);

adding an aqueous dispersion (L) comprising:

(a) a wax which is (a1) a carboxyl-containing hydrocarbon wax or a mixture of such waxes or a mixture of (a1) and (a2) at least one unmodified hydrocarbon wax, (b) a compound selected from the group consisting of: polyacrylamide; copolyacrylamide; copolymethacrylamide; polymethacrylamide; or mixtures thereof, which is (b1) at least one macrocompound where said macro compound is selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W = n \cdot 10^6$, where $n \geqq 10$, or a mixture of (b1) and (b2) at least one compound selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W < 10 \cdot 10^6$, where components (a) and (b) constitute dispersed particles, said dispersed particles range in size from 0.01 to 10 $\mu$m;

and (d) a dispersant system consisting of amphoteric, anionic and/or nonionic surfactants;

adding the textile aftertreatment agent ($T_3$);

optionally adding customary textile auxiliary chemicals;

contacting the said textile material with said aqueous bath;

optionally providing customary heating;

optionally providing rinsing;

and optionally providing washing.

4. A process for the dyeing or optical brightening of a textile material comprising the steps:

providing a vessel;

providing a textile material;

a providing an aqueous liquor;

adding aqueous textile treatment agent ($T_2$);

adding an aqueous dispersion (L) comprising:

(a) a wax which is (a1) a carboxyl-containing hydrocarbon wax or a mixture of such waxes or a mixture of (a1) and (a2) at least one unmodified hydrocarbon wax, (b) a compound selected from the group consisting of: polyacrylamide copolyacrylamide; copolymethacrylamide; polymethacrylamide; or mixtures thereof, which is (b1) at least one macrocompound where said macro compound is selected from the group consisting of a homopolymer of acrylamide or methacrylamide, a copolymer of acrylamide and methacrylamide, or a copolymer of acrylamide and/of methacrylamide with a carboxyl containing comonomer, having an average molecular weight $\overline{M}_W = n 10^6$, where $n \geqq 10$, or a mixture of (b1)and (b2) at least one compound selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W < 10\ 10^6$.

where components (a) and (b) constitute dispersed particles, said dispersed particles range in size from 0.01 to 10 $\mu$m; and (d) a dispersant system consisting of amphoteric, anionic and/or nonionic surfactants;

optionally providing customary textile auxiliary chemicals;

contacting said bath with said textile material;

optionally providing heating;

optionally providing rinsing;

and optional providing washing.

5. A process for the treatment of textile material with a treatment agent (T) selected from:

aqueous textile pretreatment agents (T1)

aqueous textile treatment agents for the dyeing or optical brightening of a textile material (T2)

or aqueous textile aftertreatment agents (T3), comprising the step of contacting the said textile material with an aqueous liquor containing (T) by an exhaust method from the aqueous liquor under treatment conditions as would otherwise lead to the formation of running crease and/or chafe marks, characterized in that the treatment with (T) is carried out in the presence of an aqueous dispersion (L) comprising:

(a) a wax which is (a1) a carboxyl-containing hydrocarbon wax or a mixtures of such waxes or a mixture of (a1) and (a2) at least one unmodified hydrocarbon wax, and (b) a compound selected from the group consisting of polyacrylamide; copolyacrylamide; copolymethacrylamide: polymethacrylamide; or mixtures thereof which is (b1) at least one macrocompound where said macro compound is selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $$\overline{M}_W = n10^6, \text{ where } n \geqq 10,$$

or a mixture of (b1) and (b2) at least one compound selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W < 10 \cdot 10^6$, in which (a) and (b) are particles which range in size from 0.01 to 10 $\mu$m and are dispersed in the aqueous phase by means of a dispersant system (D), and, after the treatment with (T) In the presence of (L), the liquor is drained and the said textile material is optionally rinsed and/or washed.

6. A process accord to claim 5, with the additional presence of a bifunctional crosslinking agent (c), a hydrotrope and/or protective colloid (e) and/or an agent for controlling the harmful effect of microorganisms (f).

7. A process according to claim 5, which is carried out in a jet-dyeing machine or in a winch-beck.

8. A process according to claim 5, and at least one of components selected from (e) a hydrotrope and/or protective colloid and/or (f) an agent for controlling the harmful effect of microorganisms.

9. Aqueous dispersion (L) for use as an adjuvant in the treatment of textiles comprising:

(a) a wax which is (a1) a carboxyl-containing hydrocarbon wax or a mixture of such waxes or a member of (a1) and (a2) at least one unmodified hydrocarbon wax, (b) a compound selected from the group consisting of: polyacrylamide; copolyacrylamide; copolymethacrylamide; polymethacrylamide; or mixtures thereof which is (b1) at least one macrocompound where said macro compound is selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $$\overline{M}_W = n \cdot 10^6, \text{ where } n \geqq 10,$$

or a mixture of (b1) and (b2) at least one compound selected from the group consisting of a homopolymer of acrylamide or methacrylamide, a copolymer of acrylamide and methacrylamide, or a copolymer of acrylamide and/or methacrylamide with a carboxyl containing comonomer, having an average molecular weight $\overline{M}_W < 10 \cdot 10^6$, wherein (b) is crosslinked with a bifunctional crosslinking agent (c), where components (a) and (b) constitute dispersered particles, said dispersed particles range in size from 0.01 to 10 $\mu$m;

(d) a dispersant system consisting of amphoteric, anionic and/or nonionic surfactants, and at least one of component selected from (e) a hydrotrope and/or protective colloid and/or (f) an agent for controlling the harmful effect of microorganisms, which is essentially free from components other than (a), (b), (c), (d), (e), (f), water and any electrolytes.

10. A dispersion (L) according to claim 9 prepared by the process consisting of the steps:

providing a vessel, providing an aqueous dispersing of (a) with (d), combining with an aqueous solution of (b), and adding (c), (e), and (f).

11. A dispersion (L) according to claim 9 in which said aqueous dispersion is prepared by the processing consisting of the steps:

providing a vessel, providing a melt of (a), adding (d), adding (e) and (b), (c) and (f).

* * * * *